US005944503A

United States Patent [19]

Van Eerden et al.

[11] Patent Number: 5,944,503

[45] Date of Patent: Aug. 31, 1999

[54] LOW NOX FLOOR BURNER, AND HEATING METHOD

[75] Inventors: John J. Van Eerden, Churchville; John J. Bloomer, Oreland; Michael W. Peacock, Jr., Warminster; Harley A. Purvin, New Hope; A. John Grever, Colmar; John J. Barba, Horsham, all of Pa.

[73] Assignee: Selas Corporation of America, Dresher, Pa.

[21] Appl. No.: 09/081,990

[22] Filed: May 20, 1998

[51] Int. Cl.[6] ..... F23M 3/00

[52] U.S. Cl. ..... 431/9; 431/173; 431/175; 431/285

[58] Field of Search ..... 431/173, 174, 431/177, 285, 9, 175

[56] References Cited

U.S. PATENT DOCUMENTS

| | | | |
|---|---|---|---|
| 2,986,206 | 5/1961 | Boelsma | 431/9 |
| 4,815,966 | 3/1989 | Janssen | 431/285 |
| 5,271,729 | 12/1993 | Gensler et al. | 431/177 |
| 5,441,403 | 8/1995 | Tanaka et al. | 431/173 |
| 5,462,430 | 10/1995 | Khinkis | 431/173 |
| 5,511,970 | 4/1996 | Irwin et al. | 431/285 |
| 5,584,684 | 12/1996 | Dobbeling et al. | 431/285 |
| 5,634,785 | 6/1997 | Bury et al. | 431/285 |

*Primary Examiner*—Carroll B. Dority
*Attorney, Agent, or Firm*—Austin R. Miller

[57] ABSTRACT

Heating fluid in a chamber comprising a floor or ceiling and an upwardly or downwardly extending heat receiving wall by positioning a vortex burner substantially at or above the chamber floor in proximity to the heat receiving wall, delivering fuel and air to the vortex nozzle and burning the fuel to make a combustion product, imparting a swirling flow to the combustion product while directing the swirling flow along an elongated path, jetting fuel at a location positioned adjacent the vortex burner, and burning the jet fuel, thereby forming jet flow combustion products that mix with the vortex burner combustion products, and directing the resulting hot mixture generally vertically adjacent to the heat receiving wall for transferring heat thereto.

14 Claims, 10 Drawing Sheets

LOW NOX FLOOR BURNER, AND HEATING METHOD

BACKGROUND OF THE INVENTION

This invention relates to a burner and more particularly to a heating chamber utilizing a low NOx floor burner to create an elongated upwardly-extending or downwardly-extending flame from burners mounted at or near a floor or ceiling of a chamber to heat an adjacent array of fluid processing equipment.

Significant environmental and other problems have been encountered due to the production of flue gases containing high contents of NOx, which tends to react under atmospheric conditions to form environmentally unacceptable conditions such as urban smog and acid rain. In the United States and elsewhere environmental legislation and restrictions have been enacted, and more are expected to be enacted in the future, severely limiting the content of NOx in flue gases.

Various burners have been proposed over the years in an effort to reduce NOx emissions. For example, special vortex burners have been successful in furnace walls to reduce NOx emissions.

Morck U.S. Pat. No. 4,239,481, which was granted to Selas Corporation of America on Dec. 16, 1980, discloses a wall-mounted vortex burner capable of burning a variety of gases having various Wobbe indices. The '481 burner produces a whirling gas that mixes with air and the mixture ignites and is thrown laterally outwardly onto a cup-shaped wall-mounted recess surrounding the burner, and then to the surface of the furnace wall.

Morck U.S. Pat. No. 4,416,620, granted to Selas Corporation of American on Nov. 22, 1983, discloses a large capacity wall-mounted vortex burner designed for burning petrochemical gas. It also functions in a wall-mounted cup.

Van Eerden et al. U.S. Pat. No. 5,697,776, granted to Selas Corporation of American on Dec. 16, 1997, discloses a vortex burner capable of; burning either liquid petroleum gas or 100% hydrogen or any mixtures of the two, or of burning natural gas.

Over and beyond the disclosures of these patents, a significant need has arisen for a low NOx burner that can be mounted at or near the floor or ceiling of a furnace or other heating chamber, and aimed upwardly or downwardly to heat substantially vertically arrayed banks of process tubing or the like.

FIELD OF THE INVENTION

In industrial fluid process systems, process tubing or pipes are often oriented or stacked substantially vertically to act as heat receiving walls.

There is a strong need for a floor or ceiling burner that can project a substantially vertically elongated flame to provide evenly distributed heat transfer to a substantially vertically extended heat receiving wall, or between rows of closely spaced heat receiving walls.

OBJECTS OF THE INVENTION

It is an object of the invention to provide a floor or ceiling burner having low NOx emissions, for use in an upwardly or downwardly oriented heating system.

It is another object of the invention to provide a burner adapted for use in a heat exchange chamber for heating process fluid in one or more banks of vertically extended heat exchange equipment.

It is yet another object of the invention to provide a method for heating process fluid in such a heating chamber.

Other objects of the invention will be apparent in view of the following description, and in the drawings.

SUMMARY OF THE INVENTION

Figure 1:
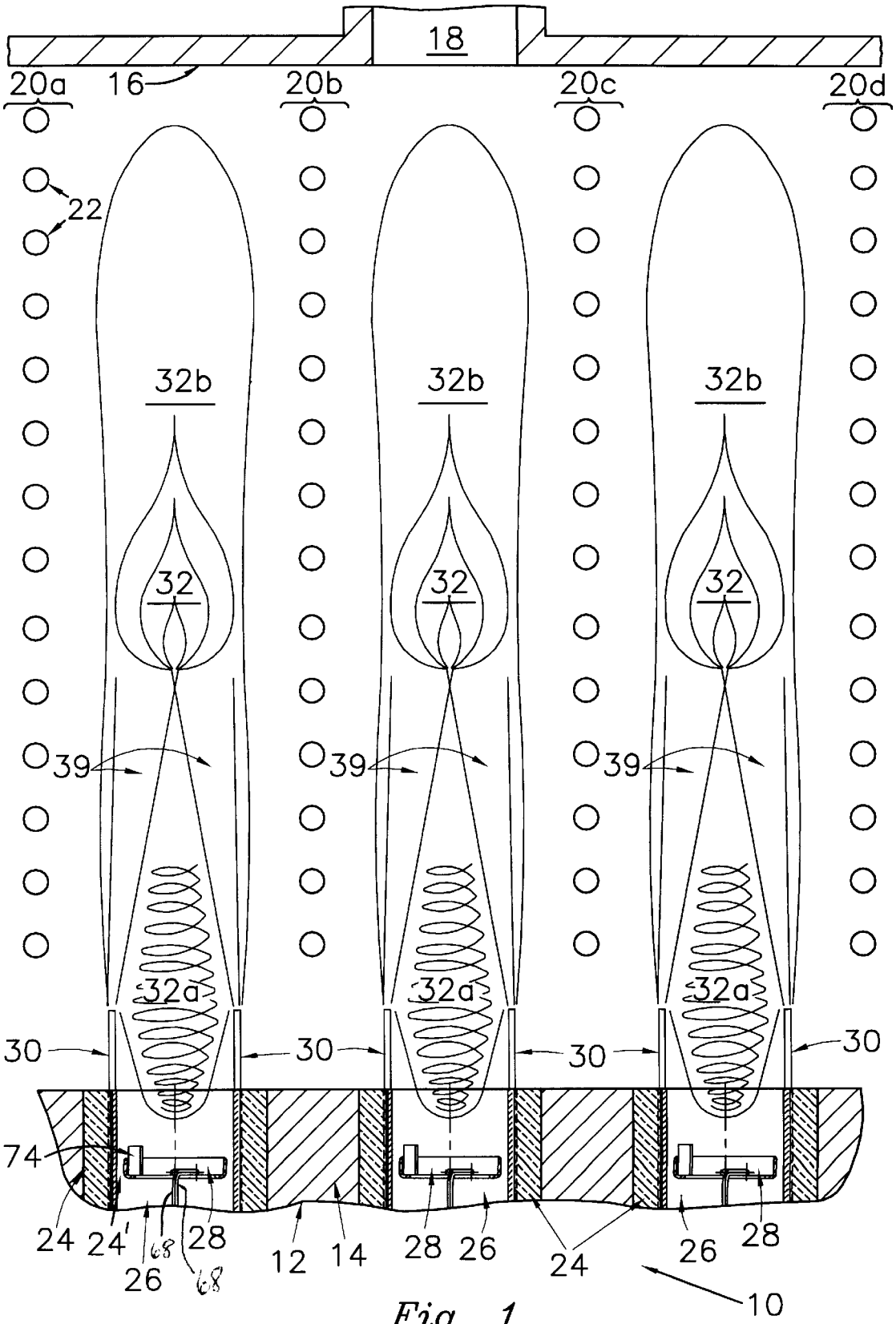
FIG. 1 is a cross-sectional side view of a heat exchange apparatus embodying this invention.

This invention relates to a low NOx nozzle mix burner especially adapted for use in a generally vertically oriented heating chamber. It is positionable to project a flame in a swirling upward flow, while directing the hot combustion products in an upwardly oriented path, while concurrently achieving an especially low NOx flue gas concentration.

In one form of the invention a jet is positioned in the chamber as selected f or illustration in the drawings, above a vortex burner, for delivering a separate supply of pressurized fuel above the vortex burner. The jet is aimed upwardly and inwardly above the path of swirling flow created by the vortex nozzle. Combustion at the vortex burner forms a lower flame that produces its own combustion gases, and the jet forms an upper flame that burns in the presence of such combustion products and remarkably reduces the overall NOx value of the overall combustion products.

In accordance with the method, fuel from the jets undergoes moderated combustion, at least in part, in the presence of combustion gases rising from the lower flame portion, forming an upper flame portion above the lower flame portion, all with moderated combustion that results in a lower NOx value in the flue gas.

DETAILED DESCRIPTION OF THE INVENTION

For ease of understanding the following description and the drawings are directed to selected embodiments of the invention. They are not intended to limit the scope of the invention, which is defined in the appended claims. Also, the drawings are not intended to be to scale or in proportion.

Referring to FIG. 1, heating apparatus 10 is shown mounted at or near the floor of a chamber to supply heat to banks of upwardly extended heat exchangers 20*a*–20*d*, as will further become apparent.

Heater 10 includes a chamber 12 having a floor 14 and a ceiling 16. A stack 18 is provided for exiting combustion gases.

Mounted within chamber 12 are vertically arrayed heat receiving walls 20*a*–20*d*, comprising process tubes 22 carrying process fluid or the like. Columns of such tubes 22 form spaced-apart heat receiving walls.

Positioned between adjacent heat receiving walls 20*a*–20*d* are burner blocks 24 each housing a burner assembly 26 at or near the floor of the chamber 12. A single row burner assemblies 26 is shown in FIG. 1: one at the left-hand side between heat receiving walls 20*a* and 20*b*; one in the middle between heat receiving walls 20*b* and 20*c*; and one toward the right-hand side in between heat receiving walls 20*c* and 20*d*.

Each burner assembly 26 comprises a nozzle-mix vortex burner 28 that is oriented to deliver fuel and air in a vertically extending spiral flow pattern that extends upwardly into the interior of chamber 12, between pairs of tubes 20*a*–20*d*. Each burner assembly 26 also comprises a plurality of vertically elongated fuel jets 30 (sometimes called "lances") that extend upwardly above the top of burner block 24 and chamber floor 14 and into an interior region of chamber 12. The jets 30 have end openings positioned for delivering raw fuel or rich fuel mix into the chamber for separate combustion.

Jets 30, as shown, extend from conduit or tubing that is oriented upwardly as shown in FIG. 1. As shown, they deliver fuel in converging paths 39 in a torch-like flame pattern. Vortex burner 28 and jets 30 cooperate to form a vertically extending and stable flame 32. Flame 32 can be (and preferably is) consistent in height with the height of the heat exchange walls 20*a*–20*d*.

As shown in FIG. 1, flame 32*a*, 32*b* extends upwardly above the axis of burner assembly 26. Lower flame portion 32*a* is substantially adjacent to and above the vortex burner 28, and a separate flame 32*b* is spaced upwardly of the jets 30.

It has been discovered that vortex burner 28 and jets 30 coact with each other, and with recirculating furnace gases, to form a remarkably stable, low NOx flame 32 even when the flame has extended height. The flame 32 is narrow in profile from side-to-side even as it approaches an upper portion of the chamber. This vertically extended and narrow flame profile is very advantageous in that it fills the spaces between adjacent heat receiving walls 20*a*–20*d* while reducing the actual contact of visible flame with the process fluid tubes 22. The height and narrow profile of the flame 32 efficiently heats a substantial height of heat receiving walls 20*a*–20*d* and also permits close spacing between adjacent walls to heat more fluid in a smaller chamber space.

All of this is accompanied by a concurrent reduction of NOx value in the overall combustion products, believed to be caused by slower, lower temperature burning of the jet combustion fuel in the presence of combustion products from the vortex burner and recirculating furnace gases.

Figure 2:
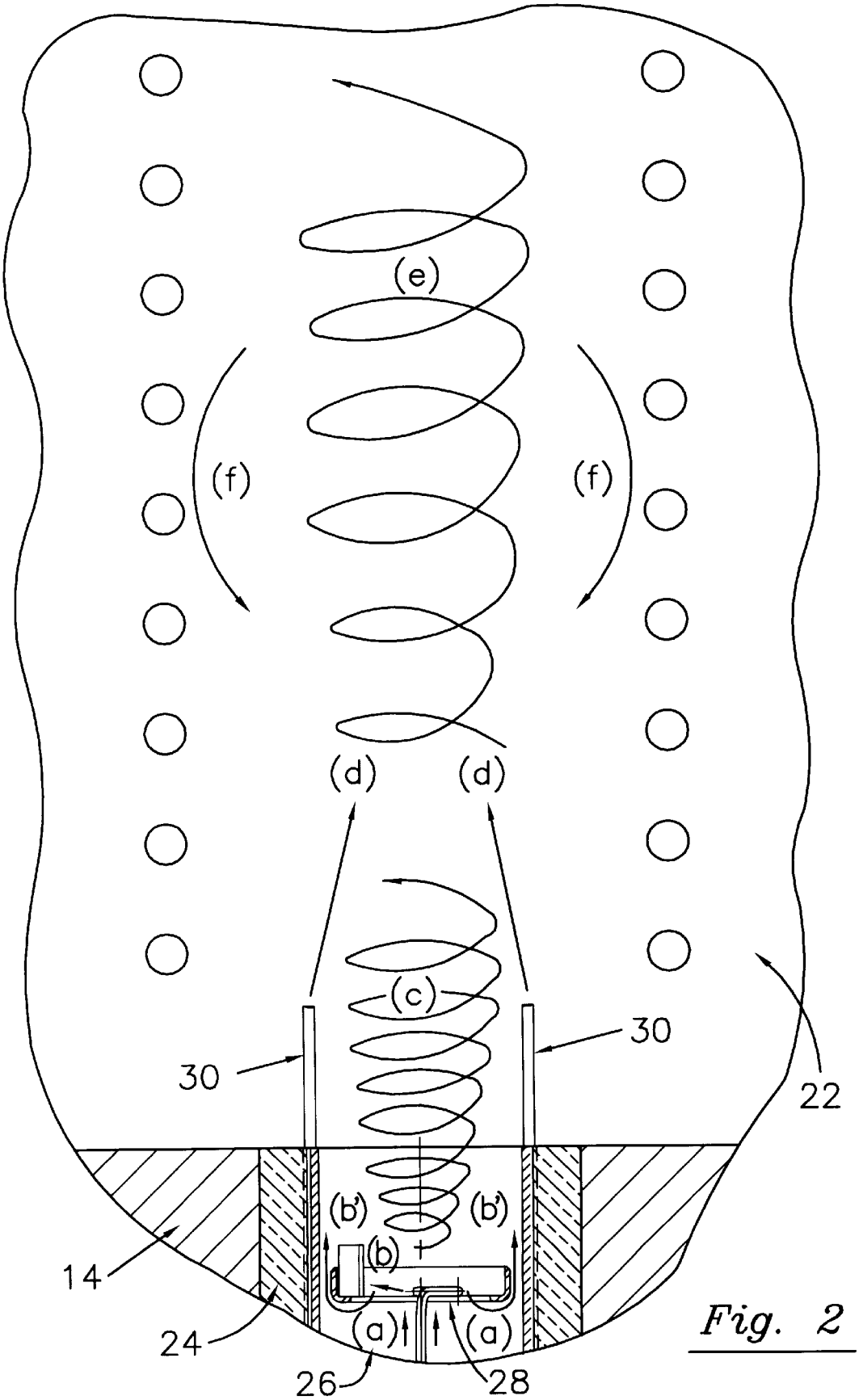
FIG. 2 is a cross-sectional side view of a portion of the heat exchange apparatus shown in FIG. 1.

FIG. 2 magnifies one of the burner assemblies 26 in order further to illustrate the burner operation. Ambient air (a) flows upwardly through burner block 24, and toward the interior of the chamber for combustion. Fuel (b) is introduced into the vortex tubes 68 and is carried upwardly in a spiraling and swirling path (b'). Combustion of air (a) and fuel (b) and (b') occurs at and above vortex burner 28.

Also, as will be described in further detail, some of the fuel (b) travels outwardly beneath the vortex burner 28 and around an outer edge of vortex burner 28 and upwardly through a space 24' (FIG. 1) between vortex burner 28 and the bore of burner block 24. This fuel path is designated "(b')". Creation of fuel path (b') contributes to the reduction of NOx because the fuel at (b') is only partially burned and moderates the overall rate and temperature of combustion in the combustion zone.

According to this invention, special jets 30 (FIG. 2) are arranged above the vortex burner and deliver strong, pressurized streams of raw or rich fuel (d) upwardly into the upper interior of the chamber. These streams are angled inwardly toward the axis, preferably at an angle of about 15–30°. The fuel flowing along path (d) burns in the presence of air and the combustion gases coming from the vortex burner; they flow upwardly to form an upper combustion zone (e). Swirling of the fuel and air above combustion zone (c) occurs in zone (e), increasing the stability of the flame and extending its vertical height.

Flame stability is strongly intensified by the high-pressure fuel jets (d), creating a flame having a surprisingly narrow profile and greatly extended vertical height admirably suited for use in the space between rows of process tubes 22.

As shown in FIG. 2, a recirculation (f) of combustion gases from upper combustion zone (e) takes place. Such recirculation induces moderating combustion reactions that further reduce the overall NOx emissions.

Figure 3:
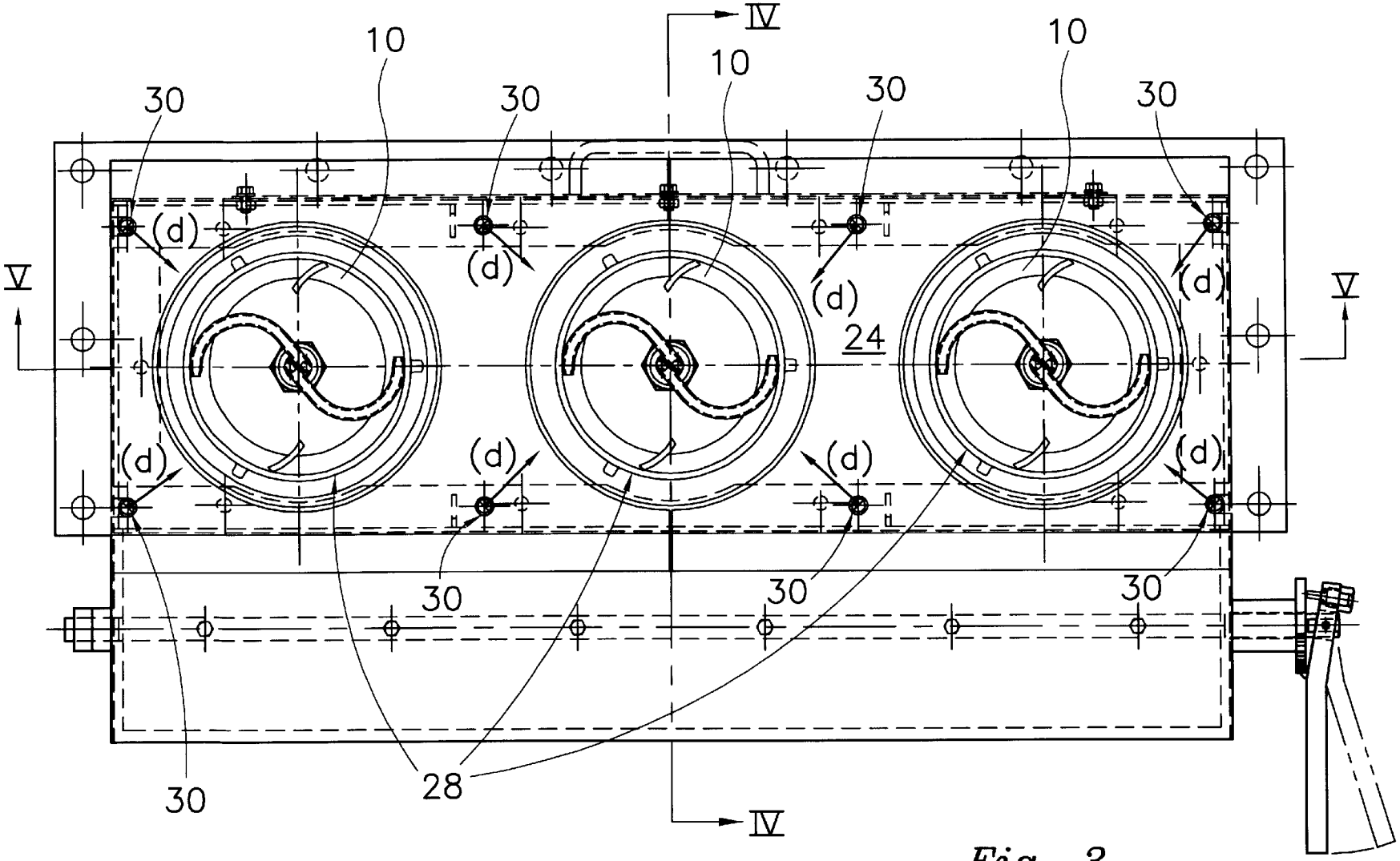
FIG. 3 is a top view of one embodiment of a burner assembly according to this invention.

Referring now to FIG. 3, a set of vortex burners 28 is shown in combination. Individual vortex burners 10 are spaced from one another in a line between adjacent heat receiving tubing walls 20*a*–20*d*. FIG. 3 shows eight pressure jets 30, each of which jets raw fuel upwardly, angled inwardly toward the axis. The designations (d) indicate locations above the vortex burners 28 where separate additional combustion of fuel from these jets takes place.

Figure 4:
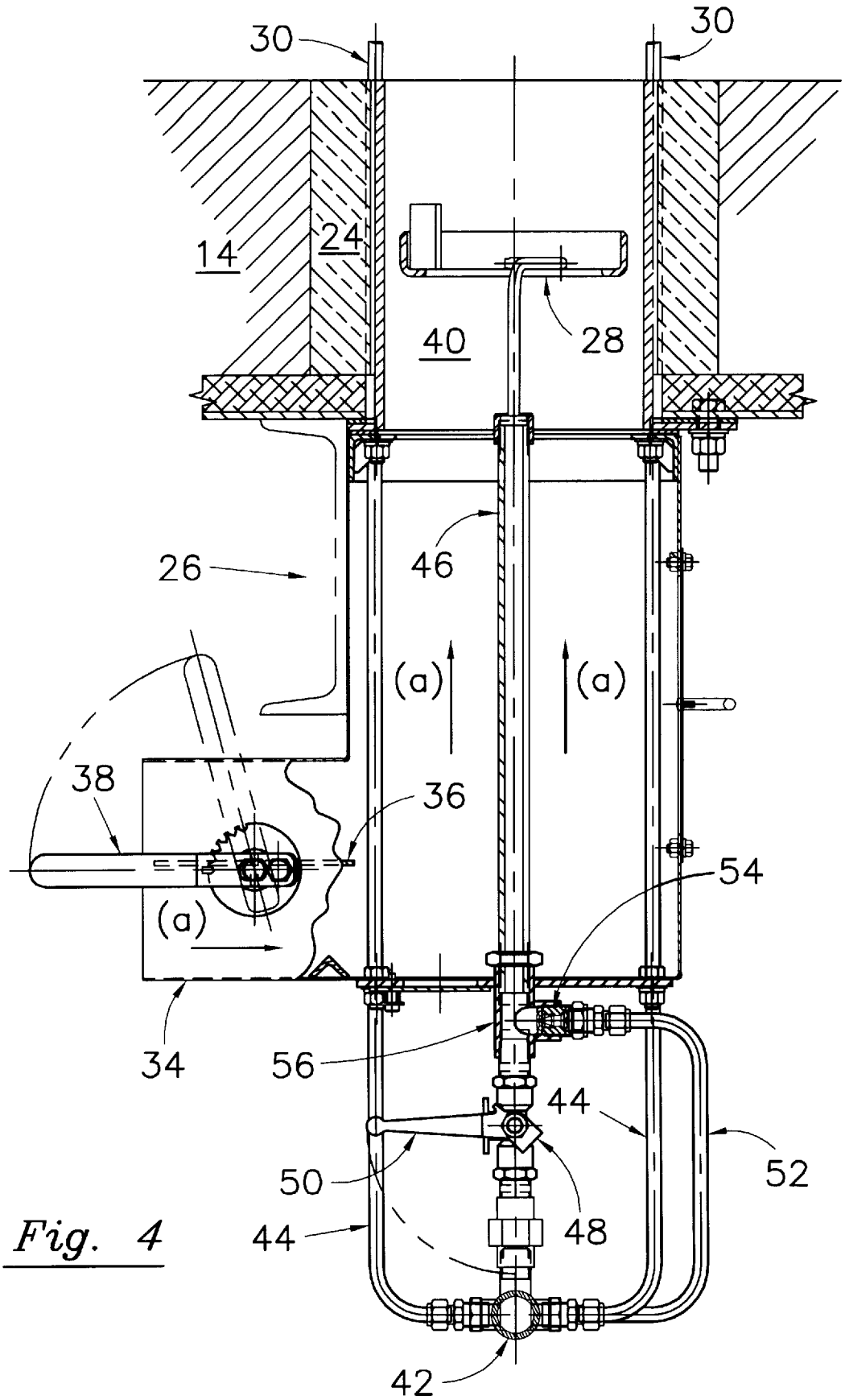
FIG. 4 is a cross-sectional side view of the burner assembly shown in FIG. 3.
Figure 5:
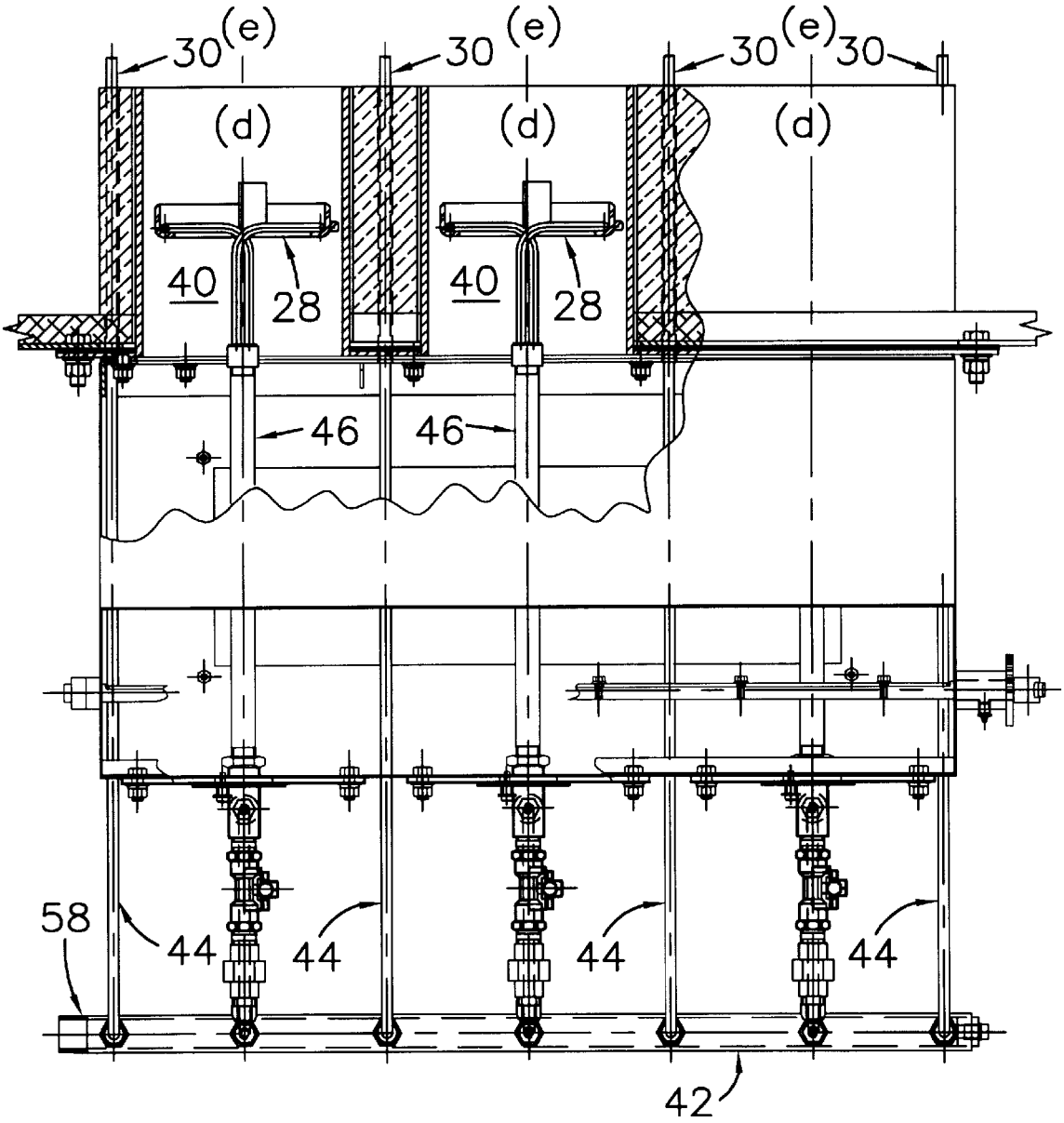
FIG. 5 is a cross-sectional front view of the burner assembly shown in FIG. 3.

Referring to FIGS. 4 and 5, according to one embodiment of the invention, air inlet 34 is provided to admit draft air to the burner assembly. A damper 36 having a handle 38 is provided to adjust the air opening. Air (a) travels through air inlet 34 and upwardly to passage 40 in burner block 24.

It is preferred to deliver more fuel through the jets 30 than through the vortex burner 28, and at a higher pressure. This facilitates a tall and vertically-extending elongated flame that extends tightly and congruently upwardly into the chamber. The jets 30 preferably deliver about 80% of the fuel or even more, while the vortex burner 28 preferably delivers as little as about 20% of the fuel or less. The relative amounts can be controlled by the use of orifices or other regulators. In the embodiment illustrated in FIG. 4, the orifice 54 limits the quantity of fuel delivered to vortex burner 28. The fact that the jets collectively deliver the majority of fuel, as compared to the vortex burner, coupled with the fuel pressure and inward angle of the jets, shapes the combustion products into tight and elongated upward spirals. The upward momentum created by the converging paths of the fuel jets carries the flame upwardly toward and to the top of the process heat exchanger. The angle of orientation of the jets toward the axis can be varied to tune the stability of the flame and its narrow, elongated profile.

The pressure of fuel delivered by the jets should be significantly greater than the pressure of fuel delivered by the vortex burner. Preferably the pressure of fuel delivered by the vortex burner is about 2 psi to about 5 psi while the jet pressure is as high as about 30 psi or even higher. The ratio of jet pressure to vortex burner pressure is preferably about 6:1, and can be as high as about 15:1 or higher.

Not only do the jet-to-burner pressure ratio and the jet-to-burner fuel delivery ratio contribute to a highly stable, vertically-extending flame with an elongated narrow profile; they contribute significantly to the reduction of overall NOx emissions. The pressure and quantity of fuel delivered by vortex burner 28 brings about a combustion zone (d) that is fuel lean and contains some excess air that continues to travel upwardly toward combustion zone (e). The quantity and pressure of fuel delivered by jets 30 causes the upper combustion zone (e) to be fuel rich. The excess fuel in combustion zone (e) burns in contact with combustion gases from combustion zone (c) and returning furnace combustion gases (f). The combination of these factors slows the overall combustion rate, reduces the flame temperature at and above the jets, and reduces the overall generation of NOx.

Figure 6:
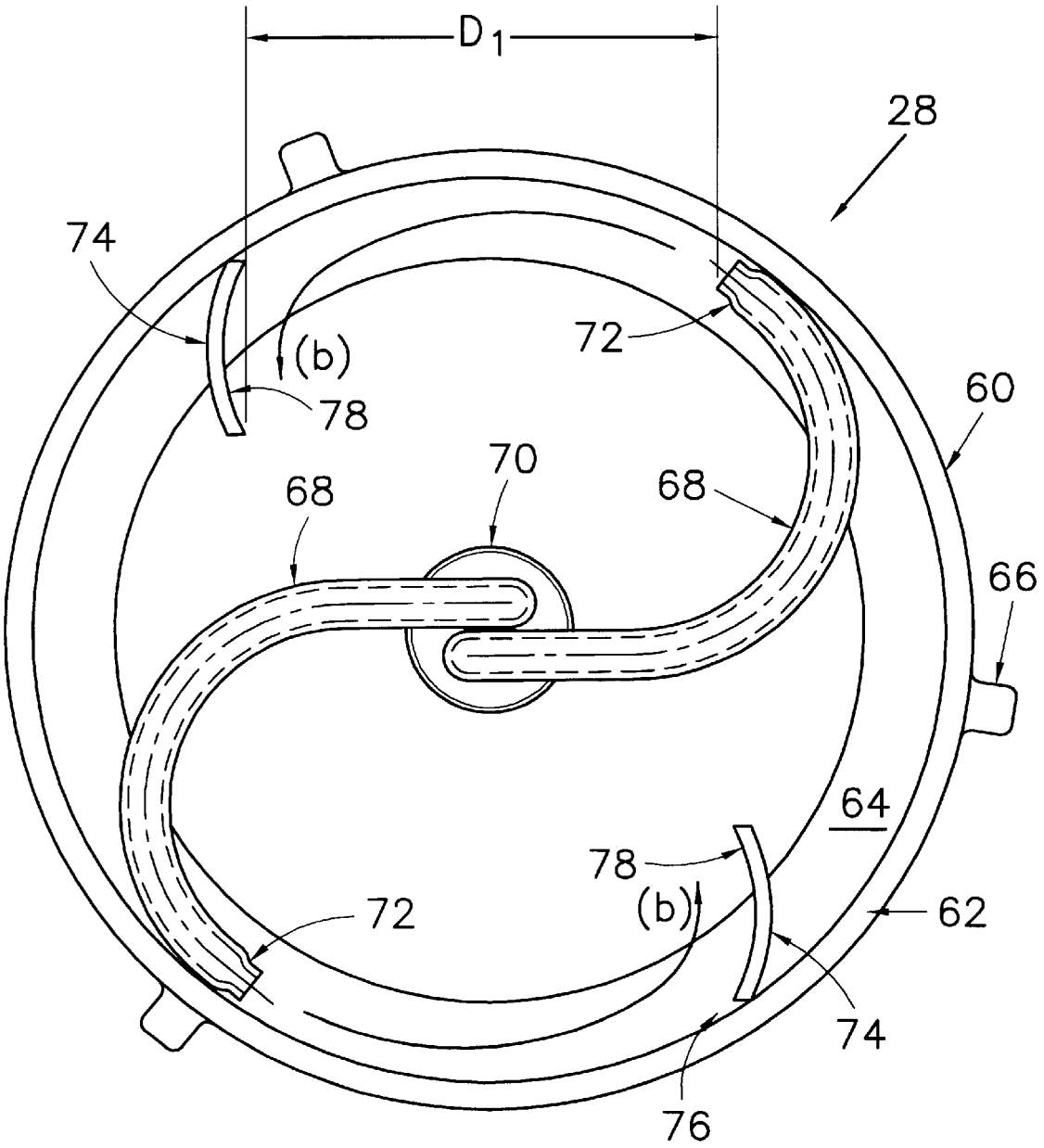
FIG. 6 is a top view of one embodiment of a vortex burner according to this invention.

Referring now to FIG. 6 of the drawings, vortex burner 28 includes a vortex ring 60 which is substantially cup-shaped with a large opening through its center for the passage of air. Vortex ring 60 has a ring wall 62 that extends upwardly about the perimeter of vortex ring 60 from a ring face 64 that extends inwardly to the open center of the vortex ring 60. On ring wall 62 are formed a plurality of centering detents 66, three shown in this embodiment at equal spacing, which provide a means for centering vortex ring 60 within the bore 40 defined in the burner block 24. Centering detents 66 also help to define a uniform annular gap between an outer surface of ring wall 62 and an inner surface of bore 40. This annular space permits the passage of fuel flow along the path (b') as described earlier with reference to FIG. 2.

A pair of vortex tubes 68, 68, carrying fuel, extend from the fuel inlet tube 46 previously described and curve radially to vortex nozzles 72 in a manner known per se. Vortex nozzles 72 deliver fuel in a spiraling path, and the incoming draft of air causes spiral flow in the combustion zone (c), as is well known.

Deflectors 74 are fixedly mounted in the vortex ring 60. They deflect the fuel flow radially inwardly to tighten the spiral. Each deflector 74 has a curved angular surface 78 that extends at an angle radially inwardly from the circumference. Each deflector 74 preferably extends upwardly in height above the upper edge of ring wall 62. However, the height of deflector 74 is not critical.

Figure 7:
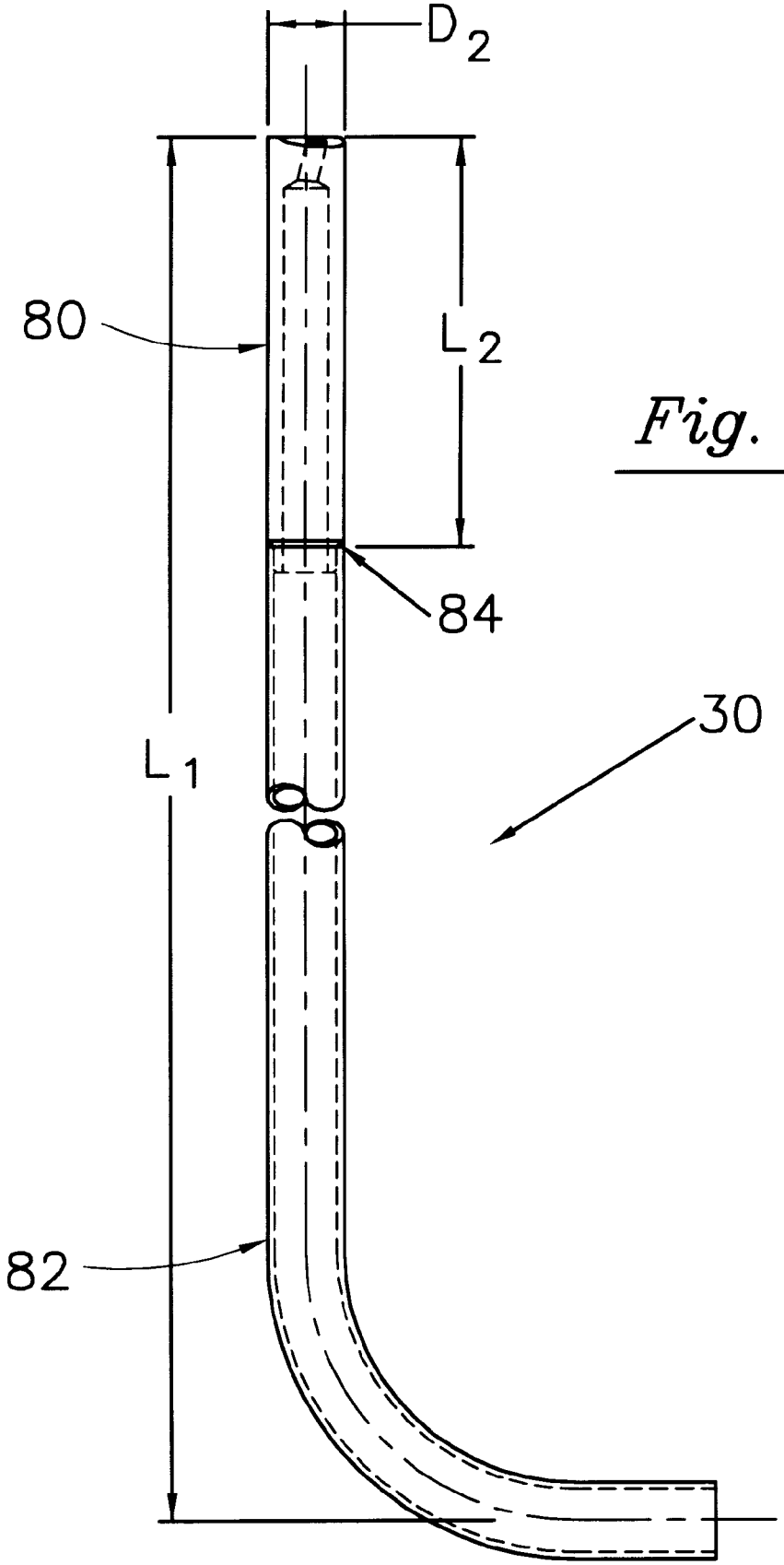
FIG. 7 is a side view of an embodiment of a fuel tube adopted for use in the burner assembly shown in FIG. 3.
Figure 8:
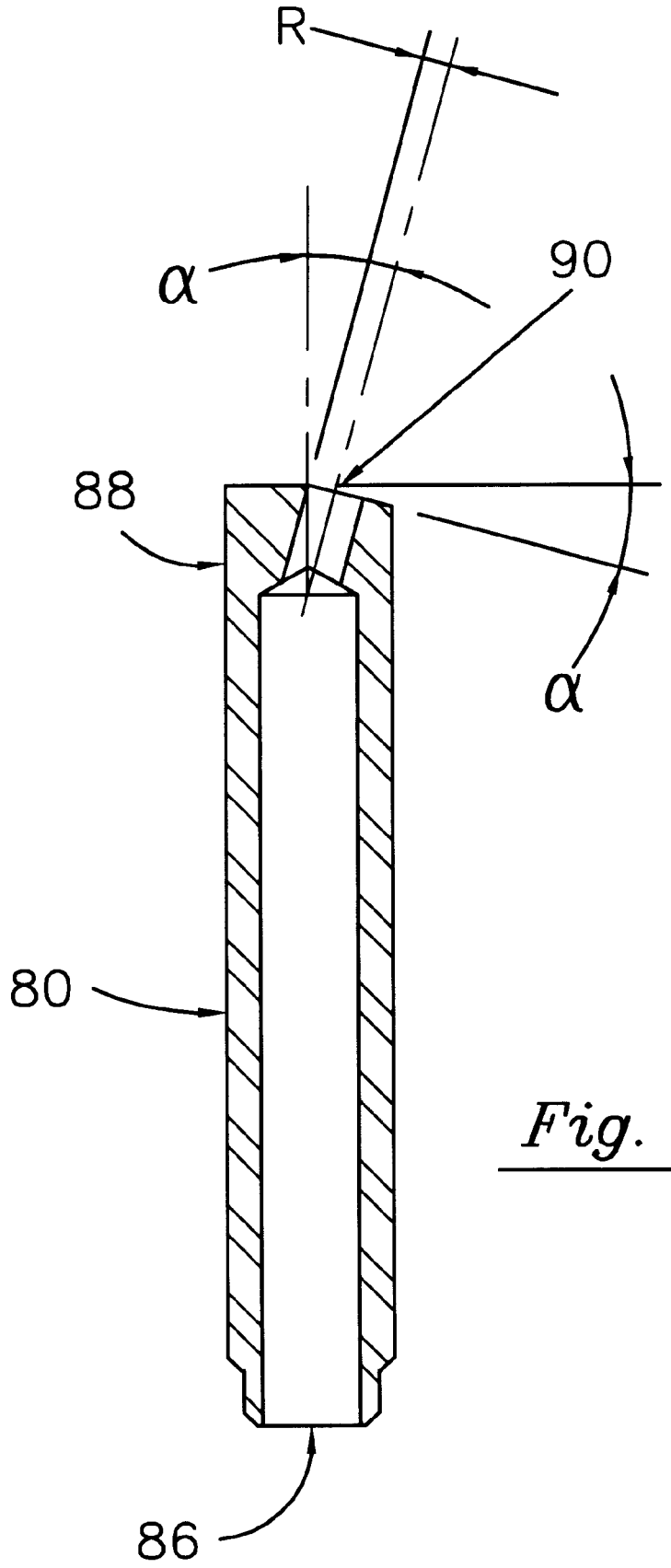
FIG. 8 is a cross-sectional side view e?f a component of the fuel tube shown in FIG. 7.

FIGS. 7 and 8 illustrate details of jet 30. Each jet 30, as shown, has a length $L_1$ extending from a central axis of a bent portion to the tip of the lance. Length $L_1$ can be selected depending upon the configuration of the burner assembly and other requirements of a particular application. The portion of jet 30 shown in FIG. 7 is formed from two components: a jet tip 80 that extends upwardly into the heating chamber and a jet body 82 that connects the jet tip 80 to the fuel supply. In this embodiment, both components 80 and 82 have a diameter $D_2$.

Jet tip 80 has a length $L_2$ and is preferably attached to body 82 by means of a weld at 84. Jet 30 is desirably but not necessarily formed from two components such as lance tip 80 and lance body 82. A heat resistant material such as HK40 may be used where the jet is intended to extend into the combustion zone. The body portion 82, not exposed to such high temperatures, can be formed from a less expensive material.

Further, forming jet 30 from two separate components makes it convenient to angle the passage toward the axis of the burner block bore without bending the jet. Referring specifically to FIG. 8, tip portion 80 has a bottom end 86, adapted for attachment to a top end of jet body 82, and a top end 88, adapted to extend upwardly into the heating chamber. Jet tip 80 can be formed of a solid rod drilled from bottom end 86. An end opening 90 can be drilled conveniently into top end 88 from the opposite end, for communication between the bore and an outer surface of the jet. The angle $\alpha$ at which end opening 90 is oriented as compared to the axis of jet tip 80 is preferably less than about 30° degrees and more preferably about 15°. The jet is oriented so that the angled opening faces inwardly. An end surface of top end 88 can be angled as indicated in FIG. 8 to provide a flat surface into which end opening 90 can be drilled, for manufacturing convenience.

Referring again to FIGS. 5 and 5, fuel is introduced to the burner assembly 26 by a fuel distribution manifold 42. Connected to fuel distribution manifold 42 are a plurality of fuel tubes 44 which deliver fuel to the jets 30.

A fuel tube 46 is connected to vortex burner 28. It is connected to the fuel distribution manifold 42 by a shut-off valve 48 having a valve handle 50. A separate fuel tube 52 is connected by a tee 56 to the fuel tube 46. Tube 52 has a flow orifice 54 adjacent to the tee 56. When the valve handle 50 is in the solid line position shown in FIG. 4, the shut-off valve 48 is in a closed position thereby preventing the flow of raw fuel directly from manifold 42 into fuel tube 46. In such a closed position, fuel flows from manifold 42 through auxiliary fuel tube 52, orifice 54 and tee 56. Orifice 54 reduces the flow of fuel delivered to the vortex burner 28. This makes it possible to deliver different amounts of fuel to the vortex burners 28 and to the jets 30.

When valve handle 50 is rotated downwardly, valve 48 opens so that raw fuel flows directly into fuel tube 46, and a greater ratio of fuel is delivered through the vortex burner 28. Such an increased fuel flow has been discovered to be especially beneficial during burner start-up. The valve 48 can be closed to adjust proportional flows and reduce NOx emissions while running.

Figure 9:
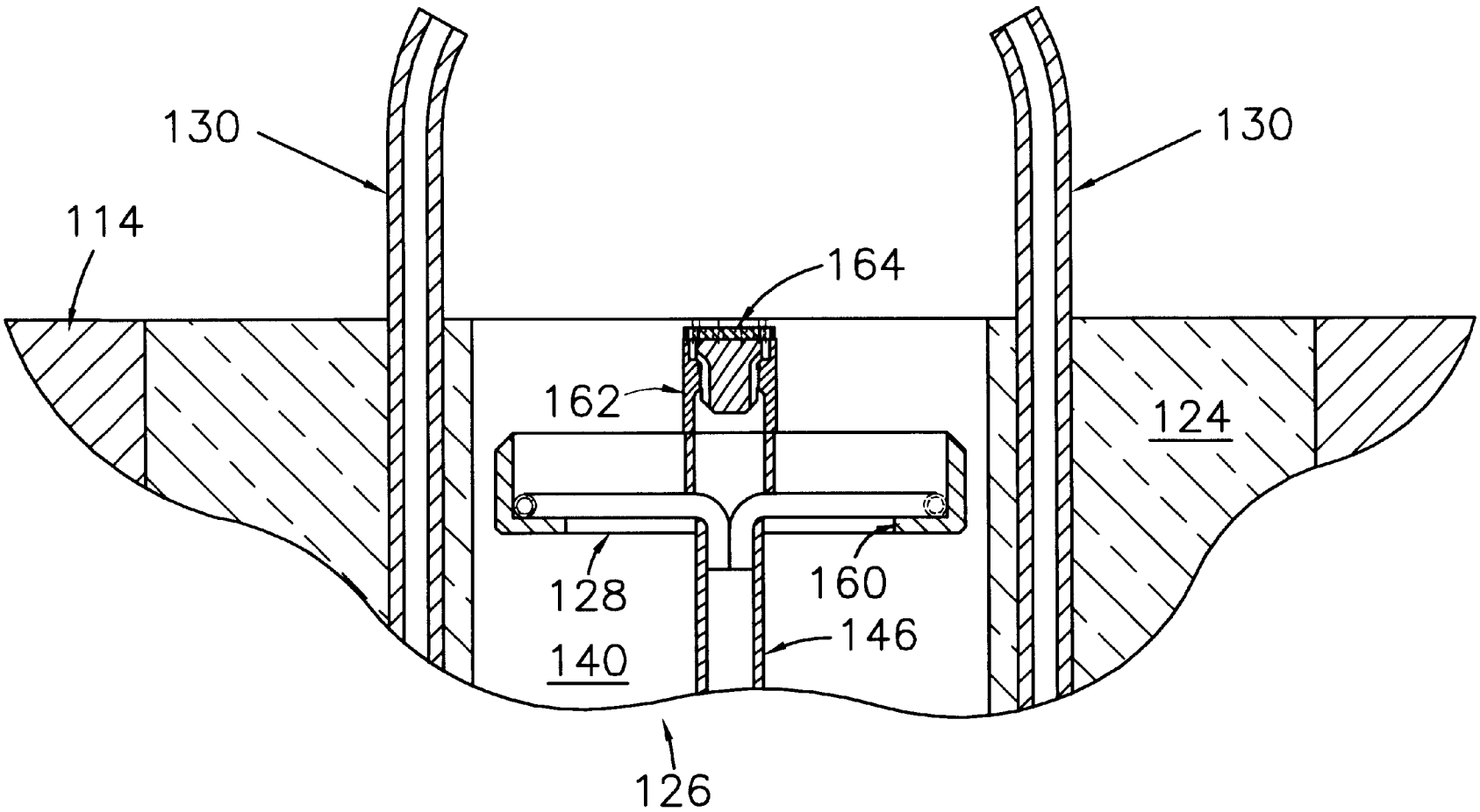
FIG. 9 is a cross-sectional side view of another embodiment of a burner assembly according to this invention.
Figure 10:
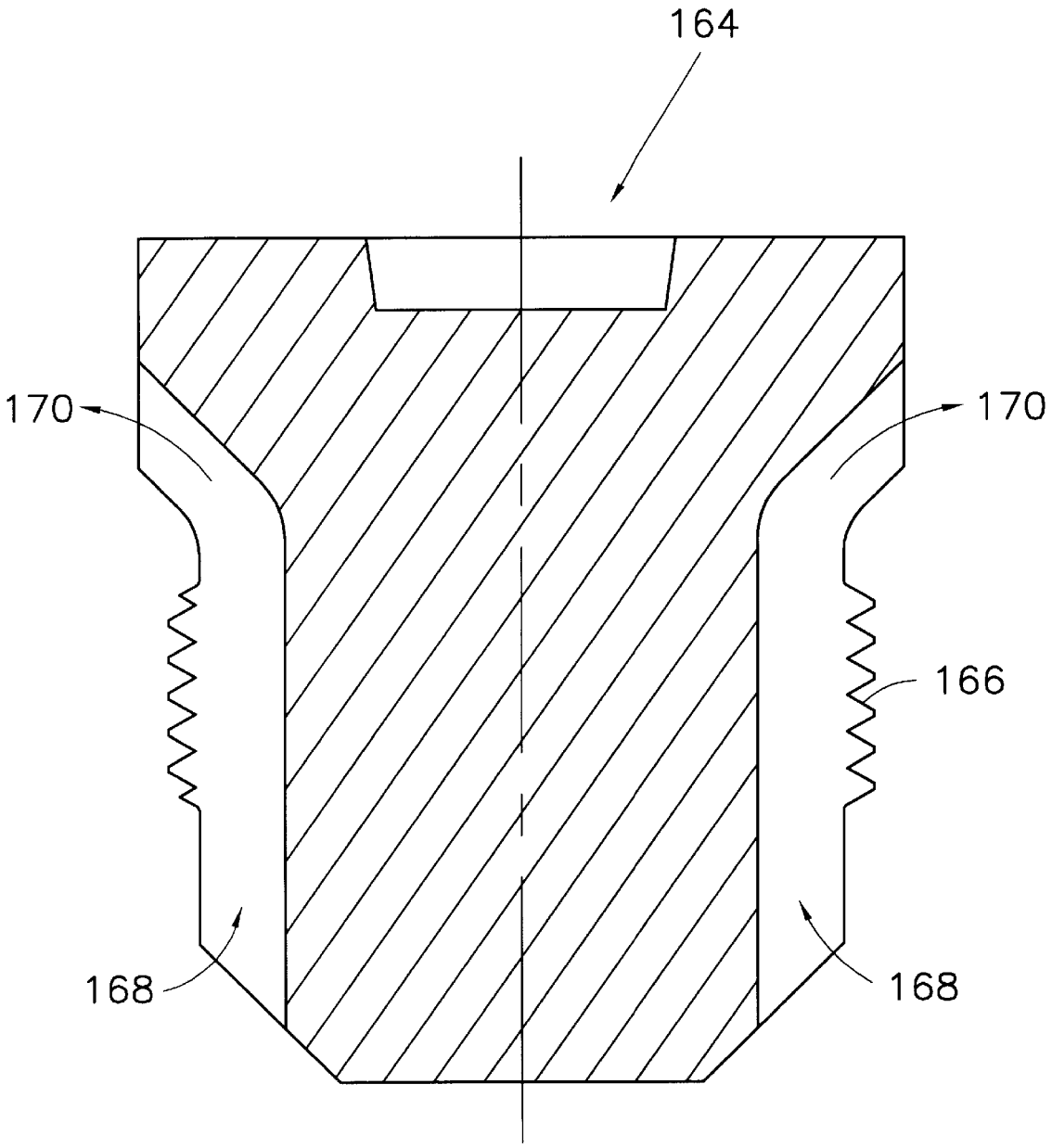
FIG. 10 is a cross-sectional side view of an embodiment of a component of the burner assembly shown in FIG. 9.

Another embodiment of a burner assembly 126 will now be described with reference to FIGS. 9 and 10. This embodiment is similar to the one illustrated in FIG. 4 but further includes a support tube 162 extending upwardly by means of a coupling from the vortex tubes 128 for delivery of fuel upwardly to a fuel distribution cone 164, details of which are shown in FIG. 10. Cone 164 diverts some flow of fuel from the upward axial direction to a radially outward direction. Specifically, as illustrated in FIG. 10, gas distribution cone 164 has male threads 166 positioned to engage female threads in support tube 162. The cone 164 also includes a plurality of longitudinal passageways 168, 170 defined by its outer surface. When the gas distribution cone 164 is threaded into support tube 162, the longitudinal passageways 168 define a plurality of radially extending outlets 170. It has been discovered that the addition of means for deflecting a portion of the primary fuel radially outwardly promotes good mixing of fuel and air in the area of combustion zone (c).

The embodiments selected for illustration in the drawings illustrate preferred features of selected variations of the invention. These embodiments can be modified in many ways, various components can be removed or substituted without departing from the scope and spirit of the invention.

This invention is adapted for use in a heat exchange process wherein a composite, low-NOx flame extends either upwardly from the floor area or downwardly from the ceiling area and heats a substantially vertically-oriented processor or heat treatment wall of any selected type or design.

The burner assembly of this invention may be positioned within a burner block located in a chamber floor or ceiling, or otherwise assembled. It can also be positioned adjacent to but above a chamber floor, or below a ceiling, depending upon design considerations.

The jets 30 can have various configurations so long as they are capable of projecting generally upwardly or downwardly into the heating chamber. The bodies of the jets may be vertically or otherwise oriented above the vortex burner. It should be noted that although eight jets 30 deliver fuel adjacent to three vortex burners 28 as illustrated, the number of jets and burners can be varied in number as desired. Arranging the jets in a generally square or rectangular configuration, around the vortex burner, provides a rectangular sheet of flame that has a larger surface area than does a cylinder with the same height. In terms of radiant heat transfer (the primary mode of heat transfer at the tubes), greater surface area means greater and more efficient heat transfer. One of the heat transfer advantages of our flame system is directly related to surface area considerations.

Many alternative configurations for jet 30 are contemplated. It can be formed from a single piece with a bore that extends vertically into the heating chamber. A slight bend, preferably less than about 30°, can be provided to an end portion in order to incline the bore toward the central axis of the burner block 24.

The radius R of end opening 90 is selected to provide a desired ratio between the amount of fuel delivered as compared to the fuel delivered by the vortex burner or burners.

The fuel provided to the jets and to the vortex burner may be gaseous or liquid, from the same or different sources, or even from the same manifold. A wide variety of fuels is contemplated, such as natural gas or 100% hydrogen, or liquid petroleum gas containing propane, or butane or any percentage mixtures thereof, or any mixture of liquid petroleum gas with hydrogen or natural gas, as desired.

Chamber 12 preferably includes at least one side wall that can at least partially enclose an interior space. The number of heat receiving walls can vary depending upon design objective.

Process tubes 22 are typically used to carry a process fluid through the chamber 12 for heat exchange. They can be oriented in any desired way. Such process tubes typically occupy a common plane. The process tubes may be connected, in a serpentine pattern, so that they have horizontal lengthwise portions. They can also have vertical portions or angled lengths that are diagonal to chamber floor 14, or at any other angle.

The bore of burner block 24 is one form of a confining means that is capable of guiding the upwardly spiraling combustion zone. Other confining means are contemplated, such as a tube or a pipe or a circumferentially extending surface that extends partially or completely around the vortex burner. Suitable confining means can also be incorporated into the vortex burner itself.

It is contemplated that one burner block 24 can house any convenient number of vortex burners 28. The vortex burners 28 can be oriented out of line with respect to one another, if desired, as in a triangle or other orientation.

As an alternative to the weldment of deflectors 74 to vortex ring 60, the ring itself can be modified by bending portions of ring wall 62 inwardly, by deforming surfaces of ring face 64 upwardly or downwardly or sidewardly, or by any other means capable of defining an angularly-arranged surface capable of deflecting fuel and air flow into a tighter spiral pattern. The distance $D_1$ between nozzle 72 and deflector 74 is not critical to the invention. Many other variations can be made without departing from the spirit and scope of the invention as defined in the appended claims.

What is claimed is:

1. Apparatus for heating a process fluid in a chamber having a floor, or roof, comprising:

a burner assembly positioned for projecting a swirling flow downstream in an elongated path extending above said floor or downwardly from said roof of said chamber;

delivery means for delivering fuel and air into said burner assembly;

said burner assembly comprising at least one vortex burner and vertically elongated fuel jet extending upwardly above the top of said at least one vortex burner;

said at least one vortex burner including a vortex nozzle a vortex ring having an opening through its center, a ring wall extending upwardly about the perimeter of said vortex ring from a ring face that extends inwardly to the open center of the vortex rings and at least one deflector positioned in said vortex ring and having a surface angled radially inwardly to direct said swirling flow radially inwardly;

means delivering fuel to said vertically elongated fuel jet for projecting fuel along said elongated path downstream of said vortex burner, said vertically elongated fuel jet being aimed to release said fuel into the path of said swirling flow from said vortex burner, to burn said fuel at a location downstream of said vortex burner;

whereby combustion in said swirling flow generates a nearer stage flame producing combustion gases extending downstream from said vortex burner, and wherein said vertically elongated fuel jet generates further combustion in a more distant stage flame that is spaced further downstream of said nearer stage flame.

2. The apparatus defined in claim 1, wherein a confining means comprising a circumferentially extending surface extends around said vortex burner to provide a path for said swirling flow of fuel and air from said vortex burner.

3. The apparatus defined in claim 1, including air and fuel controls for said vortex burner and said vertically elongated fuel jet, including means for controlling flow so that a portion of said flame is fuel lean and another portion of said flame is fuel rich.

4. The apparatus defined in claim 1, wherein said vertically elongated fuel jet has a jet axis oriented at an angle with respect to vertical.

5. The apparatus defined in claim 1, wherein said vertically elongated fuel jet has capacity to deliver into said chamber a majority of the total flow of fuel.

6. The apparatus defined in claim 5, wherein said vertically elongated fuel jet has capacity to deliver into said chamber about 80% or more of said total flow of fuel, and wherein said vortex burner has capacity to deliver about 20% or less of said total flow rate.

7. The apparatus defined in claim 5, further comprising adjustment means for increasing the flow of fuel supplied by said vortex burner during start up of said heating chamber.

8. The apparatus defined in claim 1, wherein means are provided to control the fuel pressure in said vertically elongated fuel jet to fuel pressure in said vortex burner.

9. The apparatus defined in claim 8, wherein control means are provided to control the ratio of fuel pressure in said vertically elongated fuel jet to fuel pressure in said vortex burner at about 6:1 to about 15:1.

10. The apparatus defined in claim 1, further comprising a gas distributor spaced axially from said vortex burner and connected for delivering fuel radially outwardly to encourage mixing of fuel and air in said burner flame.

11. The apparatus defined in claim 1, wherein a plurality of said vertically extending fuel jets are distributed around said vortex burner, and wherein said vertically extending fuel jets are provided with pressurized fuel and air.

12. A low NOx nozzle mix burner adapted for connection to a fuel supply and an air supply and for delivering a composite elongated flame in a downstream direction into a heating chamber, said burner comprising:

a vortex nozzle positioned for delivering fuel into said burner, said burner being shaped for imparting a swirling flow to said fuel and air causing it to travel downstream along an axis of said burner;

said burner having a deflecting surface positioned adjacent to said vortex nozzle and arranged for directing said swirling flow inwardly toward and along a path along said burner axis;

a jet positioned downstream from said vortex nozzle for delivering fuel at a location spaced axially downstream from said vortex nozzle, said jet being aimed in substantially the same direction as the path of said swirling flow from said vortex burner;

wherein combustion in said axially extending swirling flow pattern forms a proximal flame portion having combustion gases extending axially downstream from said vortex burner, and wherein said jet fuel undergoes combustion in the presence of said combustion gases at a distal flame portion that is spaced axially downstream from said proximal flame portion.

13. A low NOx nozzle mix heating chamber comprising:

heat receiving means extending upwardly in said chamber;

a burner assembly positioned in said chamber for projecting a flame upwardly above a floor of said chamber;

an air supply connected to said burner assembly;

said burner assembly comprising;

(a) a vortex burner connected for delivering fuel into said burner assembly for combustion with said air, said vortex burner being shaped for imparting a swirling upward flow to said fuel and air, said vortex burner including a vortex nozzle, a vortex ring having an opening through its center, a ring wall extending upwardly about the perimeter of said vortex ring from a ring face that extends inwardly to the open center of the vortex ring, and at least one deflector positioned in said vortex ring and having a surface angled radially inwardly to direct said swirling upward flow radially inwardly, (b) confining means adjacent said vortex burner for directing said swirling upward flow along an upwardly oriented path, and (c) jet nozzle means positioned in said chamber downstream of said vortex burner for delivering a separate supply of fuel into said chamber downstream of said vortex burner, said jet nozzle means being aimed upwardly above said vortex burner in substantially the path of said swirling upward flow;

wherein combustion in said swirling upward flow forms a lower flame portion in said confining means above said vortex burner, and wherein said jet nozzle means fuel undergoes separate combustion in an upper flame portion that is spaced above said lower flame therein; and wherein said lower and upper flame portions extend upwardly in heat transfer proximity to said heat receiving means.

14. In a method for heating fluid in a chamber comprising a floor and an upwardly extending heat receiving wall containing a substance to be heated, the steps which comprise:

(a) positioning a vortex burner substantially at or above said chamber floor in proximity to said heat receiving wall, with said vortex burner faced upwardly and comprising a vortex nozzle, a vortex ring having an opening through its center, a ring wall extending upwardly about the perimeter of said vortex ring from a ring face that extends inwardly to the open center of the vortex ring, and at least one deflector positioned in said vortex ring and having a surface angled radially inwardly to direct a swirling flow of fuel and air radially inwardly;

(b) delivering said fuel and air to said vortex burner and burning said fuel to make a combustion product;

(c) directing said swirling flow along an upwardly oriented path;

(d) jetting fuel along said path at a location positioned above said vortex burner, and burning said fuel, thereby forming jet flow combustion products; and (e) directing the resulting flames upwardly adjacent to said heat receiving wall for transferring heat thereto.

* * * * *

UNITED STATES PATENT AND TRADEMARK OFFICE

CERTIFICATE OF CORRECTION

PATENT NO.: 5,944,503
DATED: August 31, 1999
INVENTOR(S): Van Eerden et al.

It is certified that error appears in the above-identified patent and that said Letters Patent is hereby corrected as shown below:

In column 8, at approximately line 12, please change "a vortex nozzle" to -- a vortex nozzle, -- .

In column 8, at approximately line 15, please change "of the vortex rings" to -- of the vortex ring, -- .

Signed and Sealed this

Twenty-fourth Day of October, 2000

*Attest:*

Q. TODD DICKINSON

*Attesting Officer*

*Director of Patents and Trademarks*